US006709215B1

(12) United States Patent
Sorensen

(10) Patent No.: US 6,709,215 B1
(45) Date of Patent: Mar. 23, 2004

(54) ONE-MAN, LIGHT-POLE ERECTING AND LOWERING APPARATUS

(75) Inventor: Jay A. Sorensen, Port Hueneme, CA (US)

(73) Assignee: J-Jack Corporation, Salem, SD (US)

( * ) Notice: Subject to any disclaimer, the term of this patent is extended or adjusted under 35 U.S.C. 154(b) by 74 days.

(21) Appl. No.: 10/094,876

(22) Filed: Mar. 12, 2002

(51) Int. Cl.[7] ..... B66F 11/00

(52) U.S. Cl. ..... 414/23; 414/442; 414/911; 414/620; 414/590

(58) Field of Search ..... 414/23, 910, 911, 414/729, 685, 680, 620, 642, 545, 590, 449, 448

(56) References Cited

U.S. PATENT DOCUMENTS 639,286 A * 12/1899 Prevust ..... 414/23

6,368,048 B2 * 4/2002 Womble et al. ..... 414/620 X

* cited by examiner

*Primary Examiner*—Donald W. Underwood
(74) *Attorney, Agent, or Firm*—Albert O. Cota

(57) ABSTRACT

A light-pole erecting and lowering apparatus (10) that is designed to allow a single person to install, remove and service a light pole (136) that is attached to an above-ground concrete pedestal (130). The apparatus (10) consists of an integrated unit that incorporates three major elements: a transporting dolly (12), a pole platform and pedestal attachment frame (34) and a pivoting pole-securing assembly (70). The dolly (12) includes a set of wheels (28) and casters (30) that allow the apparatus (10) to be transported over various surfaces. The pole platform and pedestal attachment frame (34) allows the apparatus (10) to be placed in either a horizontal storage and transporting position or in a vertical position. The pivoting pole-securing assembly (70) includes a pole securing platform (86) and means for allowing the platform (86) to be rotated to either a horizontal or to a vertical position and to adjust the height of an erected platform (86).

17 Claims, 6 Drawing Sheets

ONE-MAN, LIGHT-POLE ERECTING AND LOWERING APPARATUS

TECHNICAL FIELD

The present invention pertains to the general field of cranes and erecting apparatuses and more particularly to a one-man, transportable apparatus that raises, sets and removes light poles mounted on an above-ground pedestal.

BACKGROUND ART

One of the most common structures used throughout the world is a pole which is used to support streetlights and signs, to hold telephone or electrical wires, or as structural elements of a building. Typically, poles are put in place by either digging a hole, placing one end of the pole into the hole and then filling the hole with dirt or concrete, or by placing the base of the pole onto a mounting platform, such as an above-ground pedestal, and securing the pole with bolts and corresponding fasteners.

Whichever method is used requires substantial work. Most poles are too large for a single person to install or service, which often necessitates a team of workers using sophisticated equipment. It is very important to maintain a pole in a correct attitude during installation—otherwise the pole may not be straight and subsequently can not be used.

Previously, many types of utility poles have been used with integral pivoting members that attach to a pedestal in endeavoring to provide an effective means to easily maintain the pole in a correct attitude. Others have developed complex and expensive equipment that will grip the pole and position it upright or remove it from the pedestal using hydraulic or pneumatic pressure.

A search of the prior art did not disclose any publications or patents that possess the novelty and structural elements of the instant invention. However, the following U.S. patents are considered related:

| Patent Number | Inventor | Issue Date |
|---|---|---|
| 4,878,160 | Reneau et al. | Oct. 31, 1989 |
| 4,903,442 | Trommen | Feb. 27, 1990 |
| 5,398,478 | Gordin et al. | Mar. 21, 1995 |
| 5,794,387 | Crookham | Aug. 18, 1998 |

Reneau et al. in U.S. Pat. No. 4,878,160 teaches a service pole assembly using a pair of hinged support members. The members provide either a stable support of the pole in an erect condition or permit the pole to be swing downward providing convenient access for service or maintenance.

U.S. Pat. No. 4,903,442 issued to Trommen is for a mast used for measuring or illumination particularly for flight navigation lights or for wind measuring devices, which utilize a glass fiber or carbon fiber, reinforced plastic mast.

Gordin et al. in U.S. Pat. No. 5,398,478 discloses a method for rigidly elevating a structure such as a pole, which has a base member securable in the ground and a portion extending above the ground. A pole section, having a bore inside a lower end and an upper end, can be stacked upon the base upwardly by slip fitting the pole section into the base end and securing it into place.

Crookham in U.S. Pat. No. 5,794,387 teaches an apparatus for manipulating a pole relative to a base fixed rigidly in the ground. The base is gripped and provides a rigid reference point. The pole is cradled and an actuator provides force to move the pole relative to the reference point. The device is designed to detach the pole from the base or to install the pole onto the base. A pivot mechanism allows the pole to be pivoted with respect to the base to lower the pole for inspection and maintenance or to erect the pole vertically and then seat it upon the base.

DISCLOSURE OF THE INVENTION

The light-pole erecting and lowering apparatus 10 is designed to allow a single person to place a light pole onto the apparatus, to align the pole over a concrete pedestal, and to secure the light pole to the pedestal. The pedestal typically protrudes above ground level at a height ranging from 18 to 36 inches (45.7 to 91 cm). The apparatus consist of three major elements: a transporting dolly, a pole platform and pedestal attachment frame, and a pivoting pole securing assembly.

The transporting dolly is comprised of a rectangular structure having front and rear lateral members. The front lateral member has attached a pair of wheels and the rear lateral member has attached a pair of casters. The combination of the wheels and casters provides the apparatus with mobility over irregular or smooth surfaces.

The pole platform and pedestal attachment frame is pivotally-mounted to the transporting dolly adjacent the wheels and includes a pair of removable struts that are attached between the dolly and the frame. When the struts are not attached the frame can be lowered to a substantially horizontal storage, servicing and transporting position. Conversely, when the struts are attached, the frame is secured in a substantially vertical position that can range from 0 to substantially 120 degrees as referenced from the vertical plane of the transporting dolly. The frame further includes a pair of frame-to-pedestal ratchet tie-downs that are used to attach the frame, when the frame is in the erected position, to the pedestal by surrounding the pedestal with a pair of straps and tightening the ratchet tie-downs until the straps provide a secure attachment.

The pivoting pole securing assembly includes a pole securing platform that is pivotally-attached to the frame, and that has a set of ball-lock, pole-attaching posts each having a pole-to-post ratchet tie-down that secures the pole to the posts with a set of straps. The platform further includes a platform pivoting actuator and a platform height-adjusting actuator. The platform pivoting actuator allows the platform to be rotated to either a horizontal or to a vertical position. The platform height-adjusting actuator allows an erect platform to be moved up or down on the frame to position the pole in alignment to allow the pole to be secured or removed from the concrete pedestal.

In view of the above disclosure, it is the primary object of the invention to produce a light-pole erecting and lowering apparatus that allows a single person to install, remove and service a light pole of the type that are attached to an above-ground concrete pedestal.

In addition to the primary object of the invention it is also an object of the invention to provide a light-pole erecting and lowering apparatus that:

- is easily transported on a light vehicle to a construction site having light poles,
- can accommodate light poles of various diameters and having various polygonal cross-sections,
- eliminates the need for having any cranes or other like equipment,
- can be made in various metals or composite materials,
- is relatively maintenance free, and
- is cost effective from both a consumer and manufacturing point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
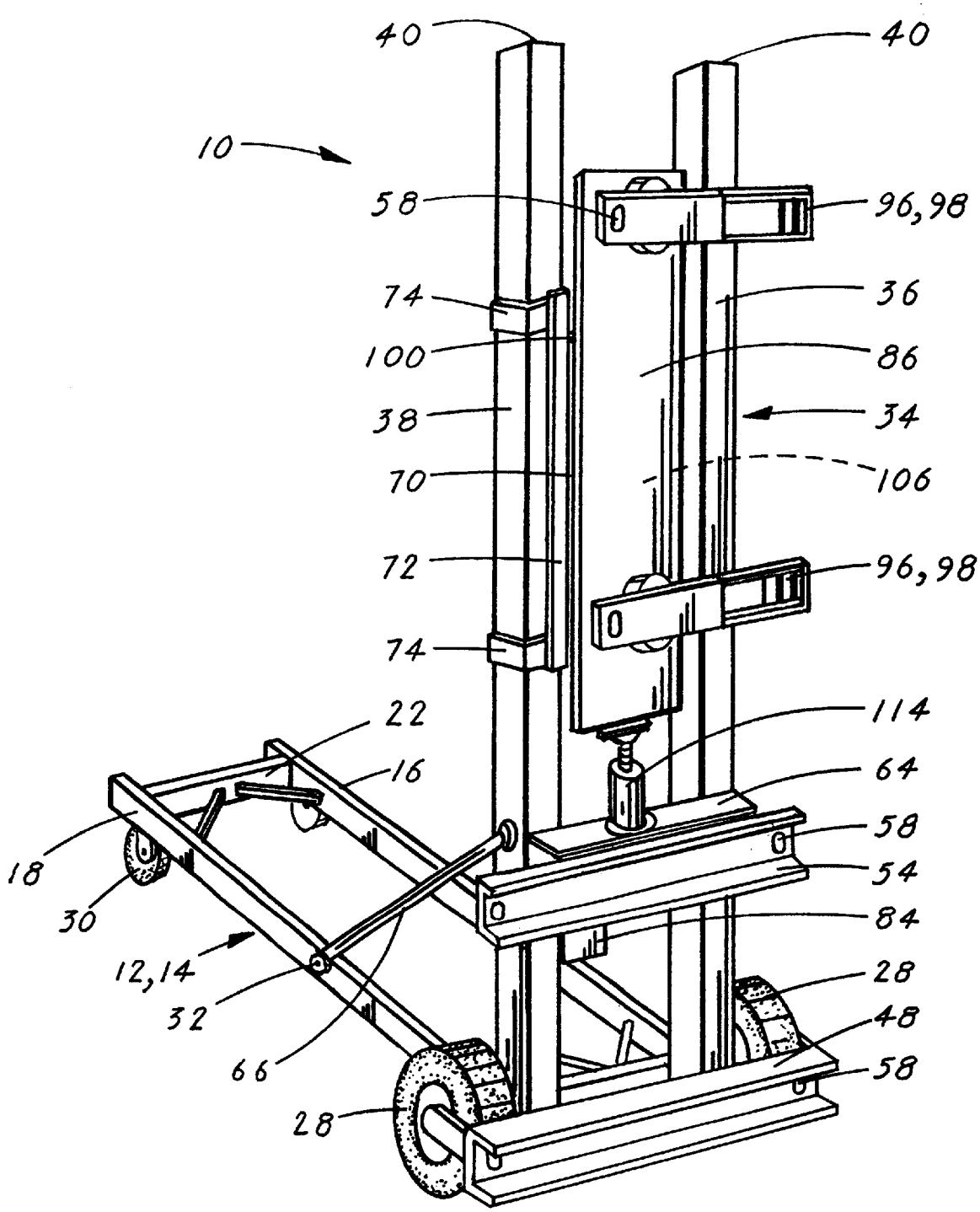
FIG. 1 is a perspective view of the one-man light-pole erecting and lowering apparatus shown with a pole platform and a pedestal attachment frame, a pivoting pole-securing assembly, and an adjustable pole securing platform in a substantially vertical position as referenced from a transporting dolly.

The best mode for carrying out the invention is presented in terms of a preferred embodiment for a one-man, light-pole erecting and lowering apparatus 10. The preferred embodiment, as shown in FIGS. 1 through 12, is comprised of the following major elements: a transporting dolly 12, a pair of wheels 28, a pair of casters 30, a pole platform and pedestal attachment frame 34, a pair of removable struts 66, a pivoting pole securing assembly 70, an adjustable pole-securing platform 86, a platform pivoting actuator 106, and a platform height-adjusting actuator 114. The inventive elements function in combination with an above-ground concrete pedestal 130 and a light pole 136. The pedestal, which typically protrudes above ground level at a height ranging from 18 to 36 inches (45.7 to 91 centimeters), has on its upper surface 132 a set of mounting studs 134, and the light pole 136 includes a mounting base 138 having a set of complimentary bores 140. When the base of the pole 136 is placed over studs 134 and the studs are tightened by means of threaded fasteners 142 the pole 136 is secured to the pedestal 130.

Figure 2:
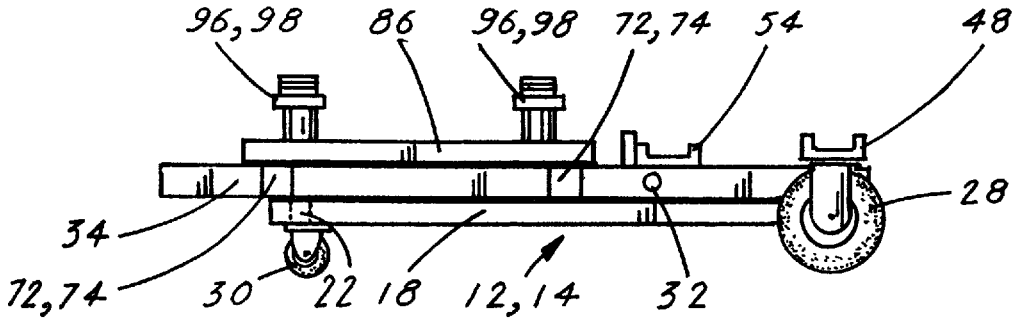
FIG. 2 is a side elevational view of the transporting dolly with the pole platform and pedestal attachment frame shown in a folded, flat storage and transportation position.

The light-pole erecting and lowering apparatus 10 with the pole platform and pedestal attachment frame 34 and the pivoting pole securing assembly 70 in a substantially vertical position is shown FIG. 1 and in a folded, flat storage and transporting position in FIG. 2. The frame 34 is pivotally-mounted to allow a movement ranging from 0 to substantially 120 degrees as referenced from the vertical plane of the transporting dolly 12. All the structural elements of the apparatus 10 are constructed of metal, that preferably consist of aluminum, which produces a total weight that allows the apparatus to be lifted and manipulated by one person.

Figure 3:
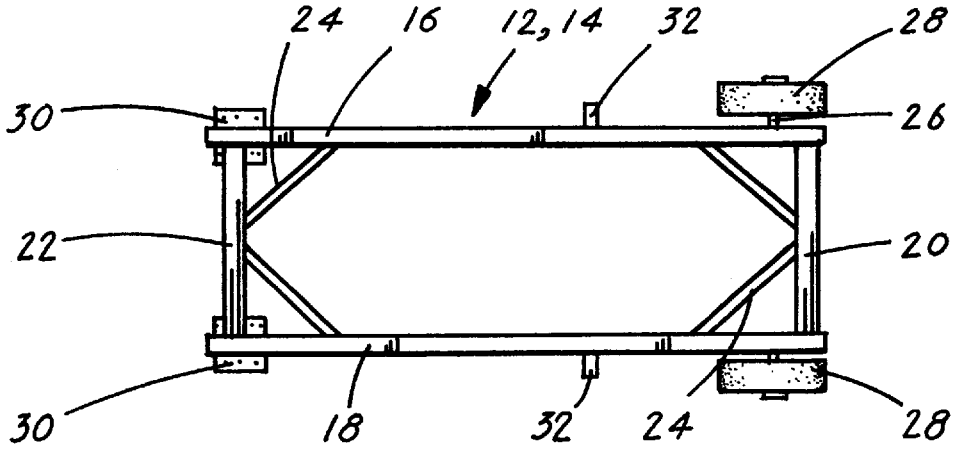
FIG. 3 is a top plan view of the transporting dolly.
Figure 4:
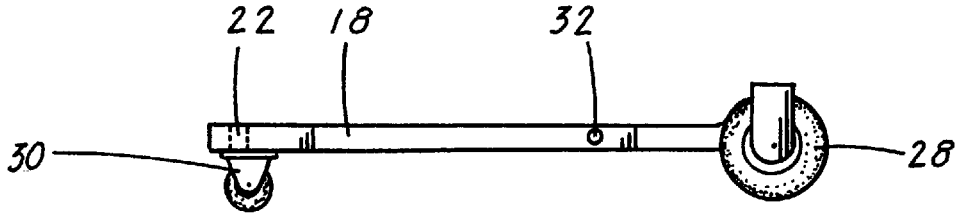
FIG. 4 is a side elevational view of the transporting dolly.

The transporting dolly 12, as shown in FIGS. 1–4, is comprised substantially of a rectangular structure 14, which includes a first longitudinal member 16 and a second longitudinal member 18. Each member 16,18 is supported by a front lateral member 20 and a rear lateral member 22, which are preferably attached by means of a welding process. Axially and rotatably attached to each end of the front lateral member 20 is a front wheel 28 and to the rear lateral member is rotatably attached a caster 30. The wheels 28 are preferably comprised of pneumatic tires having a diameter of 10-inches (25.4 centimeters) and 4.10/3.50 size rated. To add strength and rigidity to the dolly 12 a plurality of corner gussets are disposed on each inner corner of the rectangular structure 14 as best shown in FIG. 3.

Figure 5:
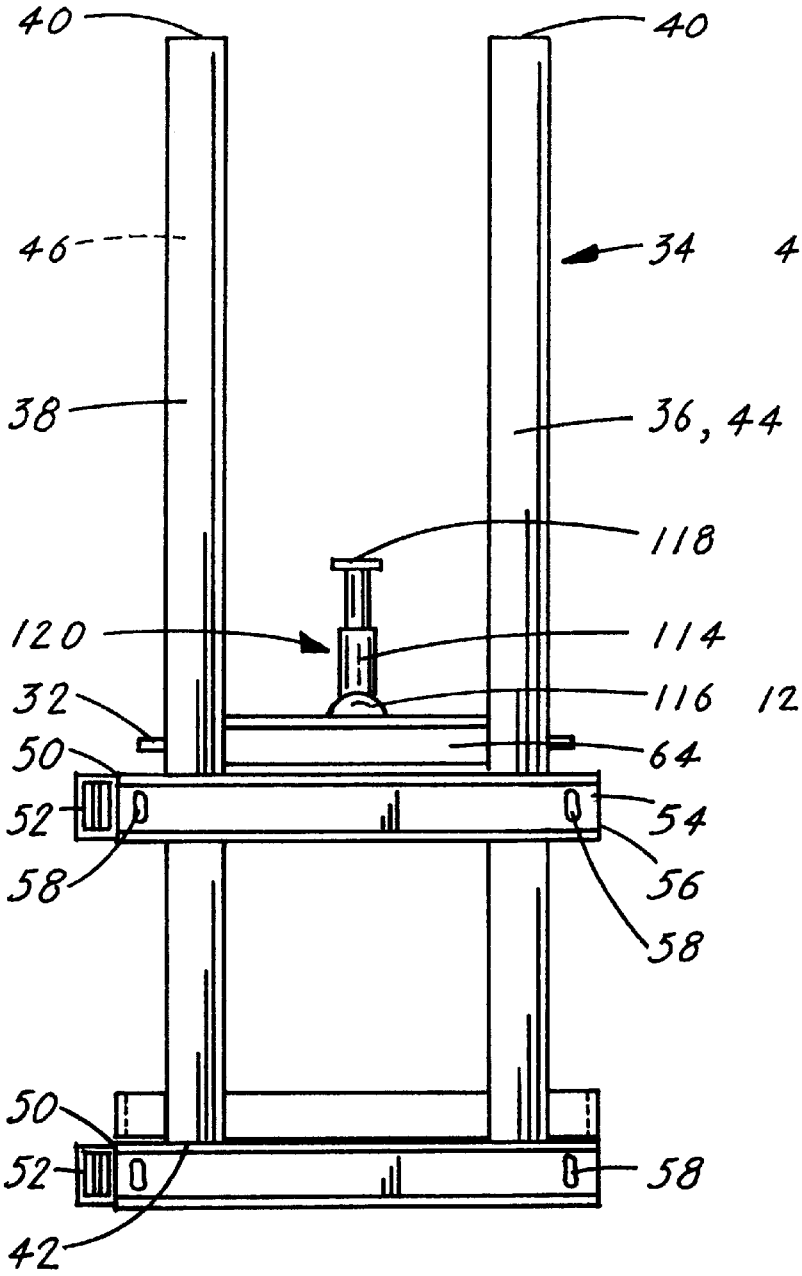
FIG. 5 is a front elevational view of the pole platform and pedestal attachment frame.
Figure 6:
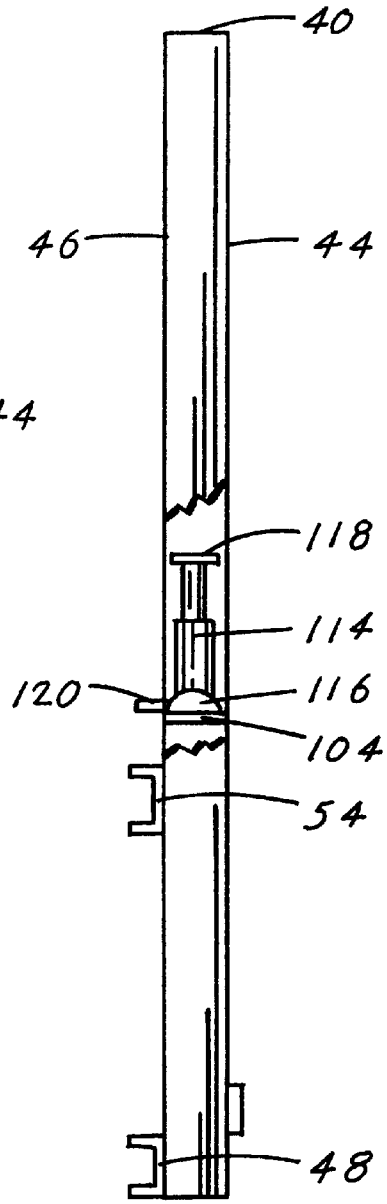
FIG. 6 is a side elevational view of the pole platform and pedestal attachment frame.

The pole platform and pedestal attachment frame 34, as shown in FIGS. 1, 5 and 6, is pivotally-mounted to the transporting dolly 12 and is comprised of a first rail 36, a second rail 38, a lower lateral member 48, an upper lateral member 54, and an actuator-mounting, lateral member 64. The first rail and second rails 36,38 each have an upper end 40, a lower end 42, an outer surface 44 and an inner surface 46. The lower lateral member 48 is attached across the outer surface 44 of the first and second rails 36,38 and includes near an outer edge 50, a frame-to-pedestal ratchet tie-down 52 and on the opposite outer edge 56, a strap receiving bore 58. The upper lateral member 54 is also attached across the outer surface 44 of the first and second rails 36,38, above the lower lateral member 48, and includes near an outer edge 50 a frame-to-pedestal ratchet tie-down 52 and on the opposite outer edge 56 a strap receiving bore 58. The actuator-mounting lateral member 64 is likewise attached to the rails 36,38 above the upper lateral member 54.

The frame-to-pedestal ratchet tie-downs 52, in combination with a set of 2-inch (5.1 centimeters) wide straps 60, are used to secure the pole platform and pedestal attachment frame 34 to the concrete pedestal 130 by surrounding the pedestal 130 with the straps 60 and tightening the straps 60, by means of the frame-to-pedestal ratchet tie downs 52, until a secure attachment is achieved. The frame-to-pedestal ratchet tie-downs 52 and the pole-to-post ratchet tie-downs 98 (described infra) are each rated to at least 10,000 pounds (4536 kg).

The removable struts 66, as best shown in FIG. 1, are attached to a set of strut attachment pins 32 located between the first and second longitudinal members 16,18 of the dolly 12 and the corresponding first and second rails 36,38 on the frame 34. When the struts 66 are not attached to the rails 36,38, the frame 38 can be manually lowered to a substantially horizontal storage and transporting position. Conversely, when the struts 66 are attached to the rails, the frame 34 is secured in a substantially vertical position, as shown in FIG. 1.

The final major element described for the apparatus 10 is the pivoting, pole securing assembly 70 which is comprised of a frame traversing structure 72, an adjustable, pole-securing platform 86, a platform pivoting actuator 106 and a platform height-adjusting actuator 114.

Figure 7:
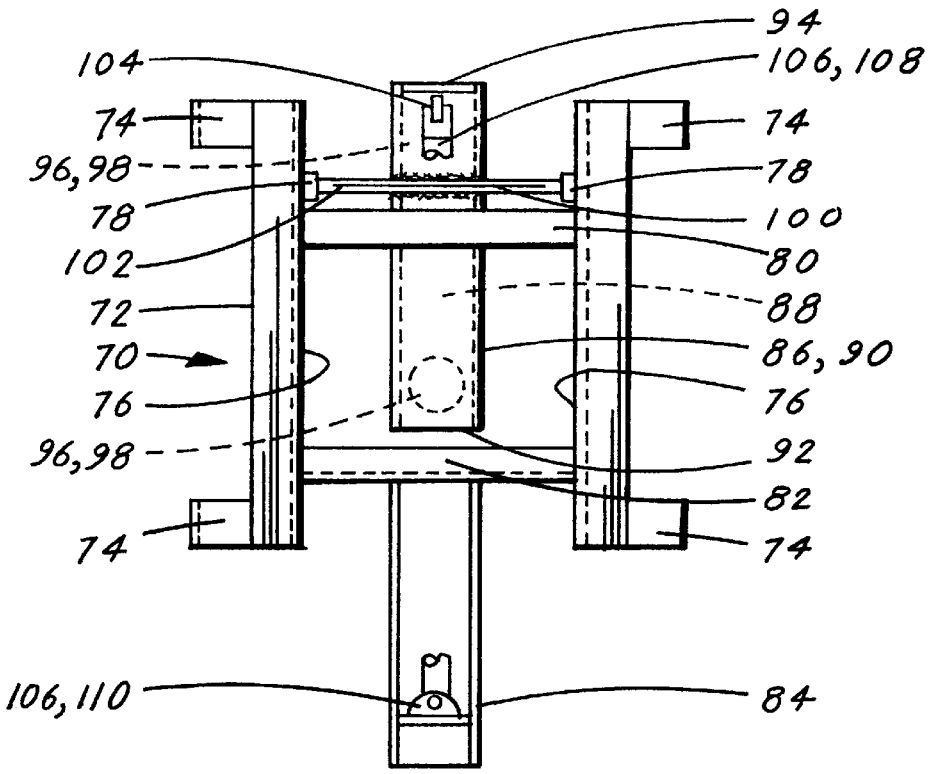
FIG. 7 is a front elevational view of a pivoting pole-securing assembly.
Figure 8:
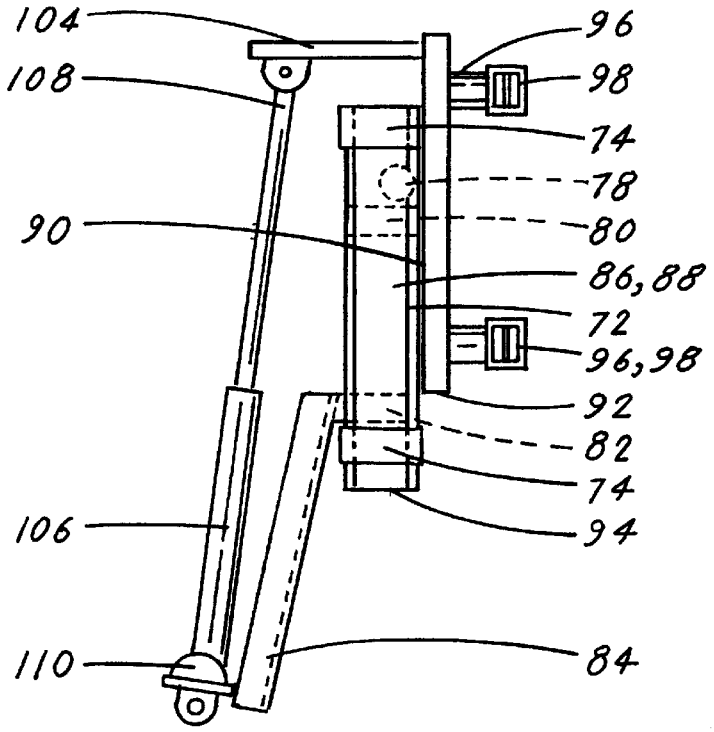
FIG. 8 is a side elevational view of the pivoting pole-securing assembly.

The frame traversing structure 72, as shown in FIGS. 7 and 8, is comprised of a set of joined channels 74 that are supported by an upper lateral member 80 and a lower lateral member 82. The channels are dimensioned to slidably traverse along the first and second rails 36,38 of the pole platform and pedestal adjustment frame 34, as shown in FIG. 1. Each channel has an inner surface 76 having an outward-extending pivot rod cavity 78.

The adjustable, pole-securing platform 86 has an outer surface 88, an inner surface 90, a front edge 92 and a rear edge 94. The platform 86 can consist of a flat plate as shown in FIG. 1, or the platform 86 can consist of a channel section, as shown best in FIG. 7. The outer surface 88, of either design, has longitudinally attached a set of ball-lock, pole-attaching posts 96, wherein each post has attached a pole-to-post ratchet tie-down 98 that, in combination with a set of straps 60, are used to secure the pole 136 to the platform 86 during the lowering and erection of the pole 136. The ratchet tie downs 98 are designed to accommodate irregular shaped, polygonal and round poles 136. To the inner surface 90, as shown in FIG. 7, is attached a platform pivot rod 100 having ends 102 that are pivotally-attached to the corresponding pivot rod cavity 78 located on the frame traversing structure 72. Adjacent. the rear edge 94 of the platform 86 is attached a pivoting actuator, mounting structure 104.

The platform pivoting actuator 106 which can be manually, pneumatically or electrically operated, is preferably comprised of a traversing screw jack, as shown best in FIG. 8, has an upper end 108 that is pivotally-attached to the structure 104 attached to the rear edge 94 of the platform 86. The lower end 110 of the actuator 106 is attached to an actuator structure 84 that is attached to the upper lateral member 54 on the pole platform and pedestal frame 34, as best shown in FIG. 7. The actuator 106 allows the platform 86 to be rotated to either a substantially horizontal position or to a substantially vertical position, as shown in FIG. 1.

The platform height-adjusting actuator 114, which can also be operated manually, pneumatically or electrically, can be comprised of a scissors jack or preferably a traversing screw jack, as shown in FIGS. 1, 5 and 6. The actuator 114 includes a base 116 and a lifting head 118. The base 116 is attached to the actuator-mounting lateral member 64 located adjacent the upper lateral member 54 on the frame 34. The lifting head 118, when elevated by means of an elevating lever 120, makes contact with the lower lateral member 82 located on the frame traversing structure 72. The actuator 114 allows an erect platform 86 to be moved up or down on the frame to secure or remove the pole 136 from the pedestal 130.

OPERATION

Figure 9:
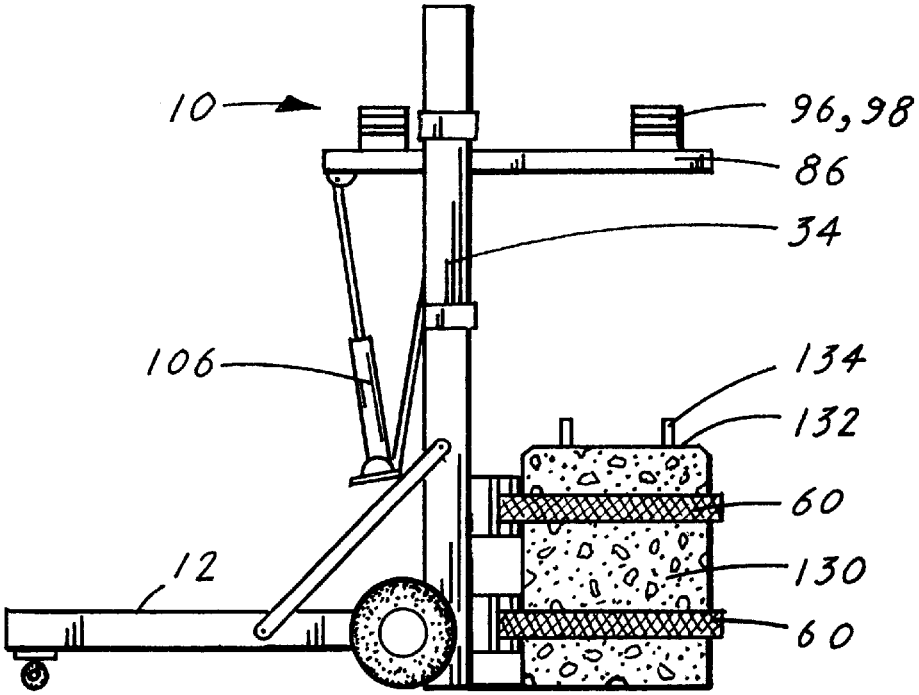
FIG. 9 is a side elevational view of the apparatus located adjacent to the concrete pedestal and attached thereto by means of straps.
Figure 10:
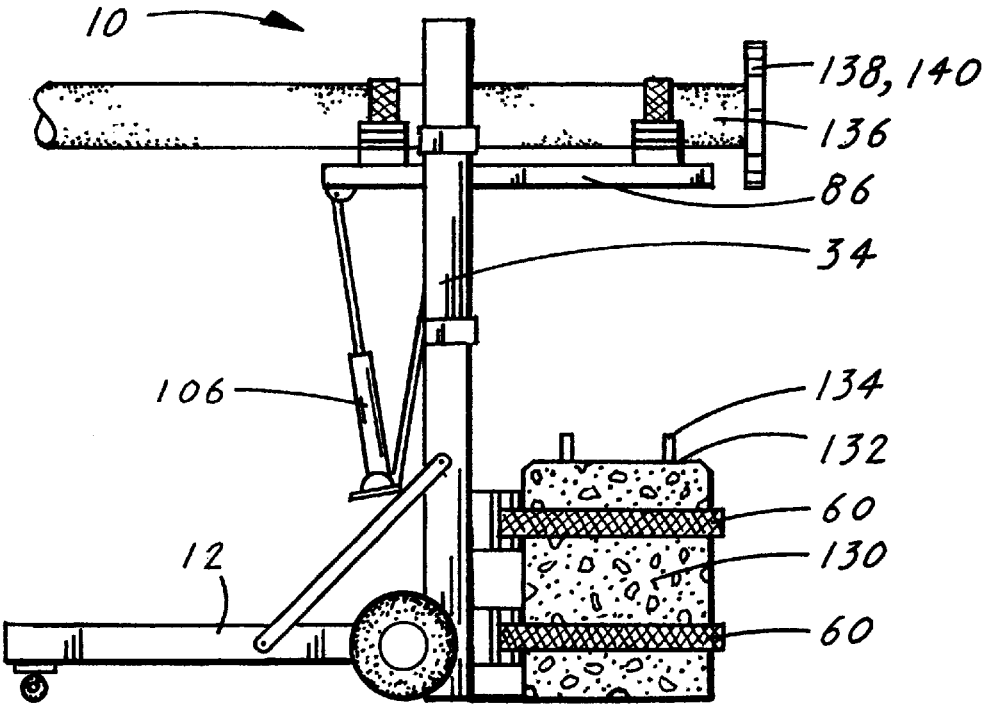
FIG. 10 is a side elevational view of the pole horizontally secured to the apparatus and located adjacent to the concrete pedestal.
Figure 11:
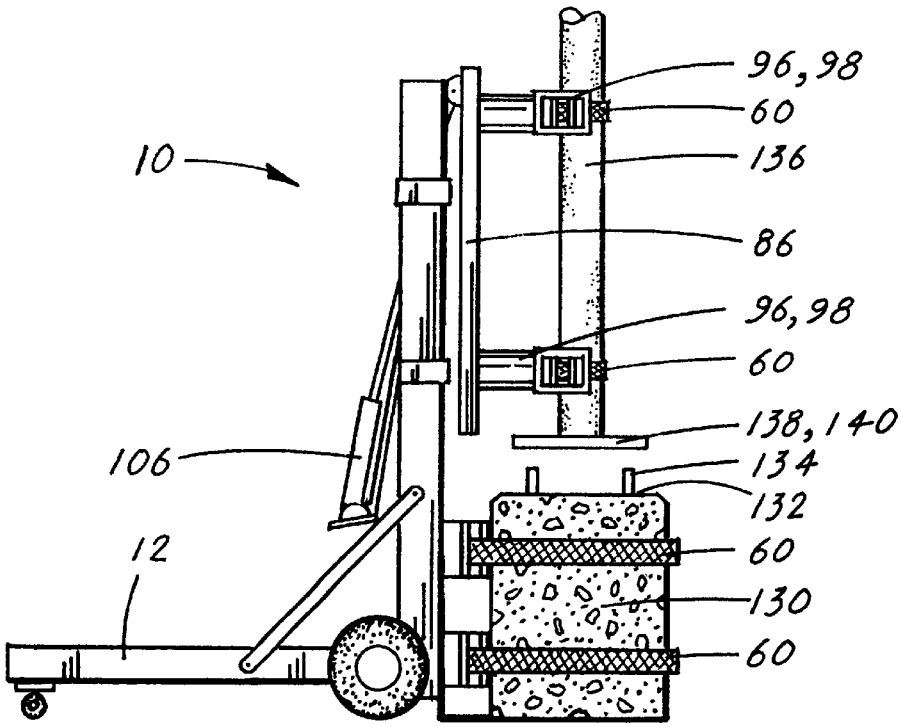
FIG. 11 is a side elevational view of the apparatus positioned with the light pole located over the mounting studs of the pedestal.
Figure 12:
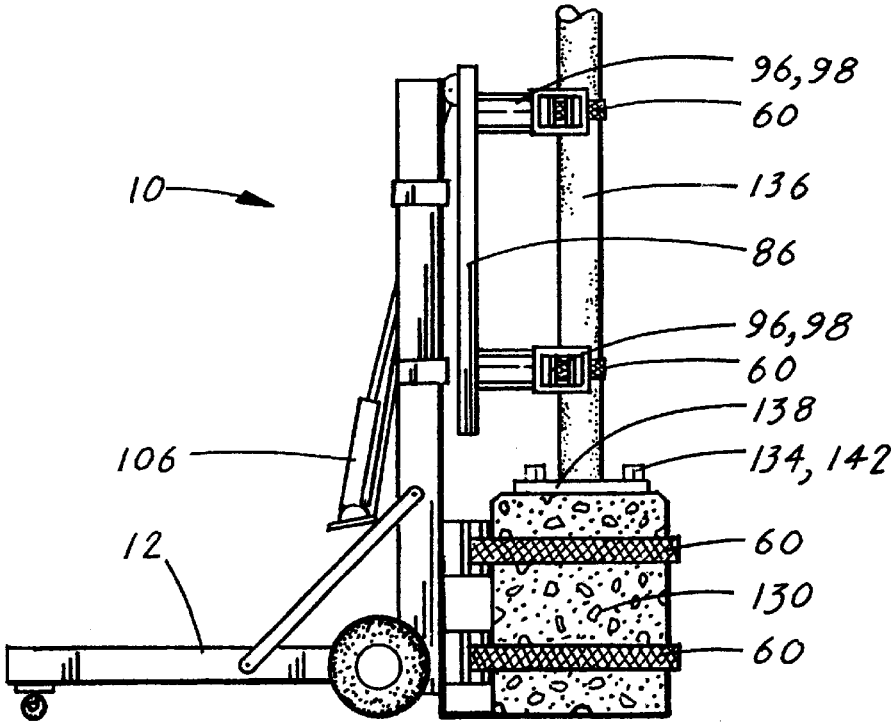
FIG. 12 is a side elevational view of the apparatus placing the light pole onto the mounting studs and attaching the pole by means of threaded fasteners.

The operation of the one-man, light-pole erecting and lowering apparatus 10 is presented in terms of a method for one person to manipulate a light pole 136 that is initially located on the ground of a construction site. The pole is to be lifted and attached to a concrete pedestal 130 having a set of integral mounting studs 134. The pole 136 includes a mounting base 138 having a set of bores 140 that correspond to the placement of the mounting studs 134. The method is comprised of the following steps:

a) Manually position the apparatus 10 adjacent to the concrete pedestal 130 and secure the apparatus 10 to the pedestal 130 by means of the frame-to-pedestal ratchet tie-downs 52 and the straps 60, as shown in FIG. 9.

b) Manually lift the pole 136 from the ground, and place and secure the pole 136 onto the apparatus 10 by means of the pole-to-post ratchet tie downs 98 and the straps 60, as shown in FIG. 10.

c) Manually tilt the pole 136, by means of the apparatus 10, to a substantially vertical position so that the pole bores 140 on the base 138 are aligned over the studs 134 on the pedestal 130, as shown in FIG. 11.

d) Manually lower the pole 136 onto the studs 134 on the pedestal 130 and attach the pole 136 by means of threaded fasteners 142, as shown in FIG. 12.

The above steps are applied in reverse when removing the pole 136 from the concrete pedestal 130.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms, which may come within the language and scope of the appended claims.

What is claimed is:

1. A one-man light-pole erecting and lowering apparatus for use with a pole that is bolted to a concrete pedestal which protrudes above ground level, said apparatus comprising:

a) a transporting dolly comprising a rectangular structure having front and rear lateral members, wherein the front lateral member has attached a pair of wheels and the rear lateral member has attached a pair of casters, wherein the combination of the wheels and casters provides the apparatus with mobility over an irregular or smooth surface, b) a pole platform and pedestal attachment frame pivotally-mounted to said transporting dolly, said frame having a pair of removable struts attached between said dolly and said frame, wherein when said struts are not attached said frame can be lowered to a substantially horizontal storage and transporting position, and conversely when said struts are attached, said frame is secured in a substantially vertical position, said frame further having a pair of frame-to-pedestal ratchet tie-downs that in combination with a pair of straps attach said frame, when the frame is in the erected position, to the pedestal by surrounding the pedestal and tightening said straps until a secure attachment is achieved, and c) an adjustable, pole securing, pivoting platform pivotally-attached to said frame, said platform having attached a set of pole-to-post ratchet tie-downs that secure the pole to said platform, said platform further having a platform pivoting actuator and a platform height-adjusting actuator, where said platform pivoting actuator allows said platform to be rotated to either a horizontal or to a vertical position, and said platform height-adjusting actuator allows said platform to be moved up or down on said frame to secure or remove the pole from the pedestal.

2. The apparatus as specified in claim 1 wherein said concrete pedestal protrudes above ground level at a height ranging from 18 to 36 inches (45.7 to 91 centimeters).

3. The apparatus as specified in claim 1 having a total weight that allows the apparatus to be lifted and manipulated by one person.

4. The apparatus as specified in claim 1 wherein said transporting dolly further comprises a plurality of corner gussets disposed on each inner corner for strength and rigidity.

5. The apparatus as specified in claim 1 wherein said wheels are comprised of pneumatic tires 10 inches (25.4 centimeters) in diameter and 4.10/3.50 size rated.

6. The apparatus as specified in claim 1 further comprising a wheel axle rotatably-attached to the front lateral member of said transporting dolly supporting the wheels in a rotating manner.

7. The apparatus as specified in claim 1 wherein said pole platform and pedestal attachment frame is pivotally-mounted, thus allowing movement ranging from 0 to substantially 120 degrees as referenced from the vertical plane of said transporting dolly.

8. The apparatus as specified in claim 1 wherein said frame-to-pedestal ratchet tie downs are rated to at least 10,000 pounds (4536 kg) and function in combination with 2-inch (5.1 cm) wide straps.

9. The apparatus as specified in claim 1 wherein said pole-to-post ratchet tie downs are rated to at least 10,000 pounds (4536 kg) and function in combination with 2 inch (5.1 cm) wide straps.

10. The apparatus as specified in claim 1 wherein said pole-to-post ratchet tie downs accommodate irregular shaped, polygonal or round poles.

11. The apparatus as specified in claim 1 wherein said platform height adjusting actuator is comprised of a traversing screw jack.

12. The apparatus as specified in claim 1 wherein said adjustable pole securing platform is comprised of a channel section.

13. A one-man, light-pole erecting and lowering apparatus for use with a pole that is bolted to a concrete pedestal which protrudes above ground level, said apparatus comprising:

a) a transporting dolly comprising a substantially rectangular structure having:

(1) a first longitudinal member and a second longitudinal member each supported by a front lateral member and a rear lateral member, (2) a wheel axially attached to each end of the front lateral member, (3) a caster rotatably attached to each end of the rear lateral member, and (4) a strut attachment pin attached to said first and second longitudinal members, b) a pole platform and pedestal attachment frame comprising:

(1) a first rail and a second rail, wherein each rail has an upper end, a lower end, an outer surface and an inner surface, (2) a lower lateral member that is attached across the outer surface of the first and second rails and that includes an outer edge having attached a frame-to-pedestal ratchet tie-down, (3) an upper lateral member that is attached above the lower lateral member across the outer surface of the first and second rails and that includes an outer edge having attached a frame-to-pedestal ratchet tie-down, wherein the first and second sets of the frame-to-pedestal ratchet tie-downs, in combination with a set of straps, are used to secure said frame to the concrete pedestal by surrounding the pedestal with the straps and tightening the straps until a secure attachment is achieved, and (4) an actuator-mounting, lateral member that is attached adjacent the upper lateral member, c) a removable strut attached between the first and second longitudinal members of said dolly and the corresponding first and second rails on said frame, wherein when said struts are not attached to the rails, said frame can be manually lowered to a substantially horizontal storage and transporting position, and conversely, when said struts are attached to the rails, said frame is secured in a substantially vertical position, d) a pivoting pole-securing assembly comprising:

(1) a frame traversing structure having a set of joined channels supported by an upper lateral member and a lower lateral member, wherein the channels are dimensioned to slidably traverse along the first and second rails of said pole platform and pedestal adjustment frame, wherein each said channel has an inner surface having a pivot rod cavity, (2) an adjustable, pole securing platform having an outer surface, an inner surface, a front edge and a rear edge, with the outer surface having longitudinally attached a set of pole-to-post ratchet tie-down that, in combination with a set of straps, are used to secure the pole to said platform during transport and erection, and wherein to the inner surface of the platform is attached a platform pivot rod having ends that are pivotally-attached to the corresponding pivot rod cavity on said frame traversing structure, wherein to the inner surface and adjacent the rear edge of the platform is attached a pivoting actuator, mounting structure, (3) a platform pivoting actuator having an upper end that is pivotally-attached to the pivoting actuator, mounting structure attached to the rear edge of said platform, and a lower end that is attached to an actuator structure attached to the lower lateral member on said, frame traversing structure, wherein said actuator allows said platform to be rotated to either a substantially horizontal or to a substantially vertical position, and (4) a manually-operated platform height-adjusting actuator having a base that is attached to the actuator-mounting lateral member located on said frame, and a lifting head which makes contact with the lower lateral member located on said frame traversing structure, wherein said actuator allows said platform to be moved up or down on said frame to secure or remove the pole from the pedestal.

14. The apparatus as specified in claim 13 wherein said pole platform and pedestal attachment frame is pivotally-mounted, thus allowing movement ranging from 0 to substantially 120 degrees as referenced from the vertical plane of said transporting dolly.

15. The apparatus as specified in claim 13 wherein said frame-to-pedestal ratchet tie-down and said pole-to-post ratchet tie-downs are each rated to at least 10,000 pounds (4536 kg) and function in combination with 2-inch (5.1 cm) wide straps.

16. A method for one person to manipulate a pole initially located on the ground onto to a concrete pedestal having integral mounting studs, wherein the pole includes a mounting base having a set of bores that correspond to the placement of the mounting studs, said method comprising the following steps:

a) position said apparatus adjacent to the concrete pedestal and secure said apparatus to the pedestal by means of the frame-to-pedestal ratchet tie-downs and the straps, b) lift the pole from the ground, and place and secure the pole onto said apparatus by means of the pole-to-post ratchet tie-downs and the straps, c) manually tilt the pole, by means of said apparatus to a substantially vertical position so that the pole bores are aligned over the studs on the pedestal, and d) manually lower the pole over the studs on the pedestal and attach the pole by means of threaded fasteners.

17. The method as specified in claim 16 further comprising a reverse procedure to remove the pole from the pedestal.

* * * * *